US006899155B2

(12) United States Patent
Francke et al.

(10) Patent No.: US 6,899,155 B2
(45) Date of Patent: May 31, 2005

(54) DEVICE FOR APPLYING SELF-ADHESIVE, SUBSTRATE-FREE LABELS TO FLAT ARTICLES

(75) Inventors: Jürgen Francke, Berlin (DE); Frank Voss, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/257,345

(22) PCT Filed: Apr. 3, 2001

(86) PCT No.: PCT/DE01/01250

§ 371 (c)(1),
(2), (4) Date: Apr. 29, 2003

(87) PCT Pub. No.: WO01/76951

PCT Pub. Date: Oct. 18, 2001

(65) Prior Publication Data

US 2003/0168178 A1 Sep. 11, 2003

(30) Foreign Application Priority Data

Apr. 10, 2000 (DE) ..... 100 17 768

(51) Int. Cl.[7] ..... B65C 9/08; B65C 9/18

(52) U.S. Cl. ..... 156/391; 156/538; 156/539; 156/556; 156/566; 156/DIG. 28; 156/DIG. 33

(58) Field of Search ..... 156/350–354, 156/510, 516, 517, 521, 523, 391, 538, 539, 540, 541, 556, 566, 567, 568, DIG. 1, DIG. 2, DIG. 24, DIG. 28, DIG. 37–40, DIG. 44, DIG. 45, 352, 558

(56) References Cited

U.S. PATENT DOCUMENTS

| | | | | |
|---|---|---|---|---|
| 2,493,737 A | | 1/1950 | Burns | 216/29 |
| 2,555,325 A | | 6/1951 | Doane | 216/30 |
| 2,640,539 A | | 6/1953 | Piper | 164/68 |
| 3,319,499 A | | 5/1967 | Hawkes et al. | 83/99 |
| 3,472,724 A | | 10/1969 | Casey | 156/521 |
| 3,628,408 A | | 12/1971 | Rod | 83/175 |
| 3,772,123 A | | 11/1973 | Clark et al. | 156/357 |
| 4,029,537 A | * | 6/1977 | Kish | 156/497 |
| 4,421,587 A | | 12/1983 | Guenther et al. | 156/256 |
| 4,701,239 A | | 10/1987 | Craig | 156/519 |
| 4,840,696 A | | 6/1989 | Krasuski et al. | 156/353 |
| 5,102,485 A | * | 4/1992 | Keeler et al. | 156/256 |
| 5,200,007 A | | 4/1993 | Svyatsky | 156/64 |
| 5,294,282 A | | 3/1994 | Rock et al. | 156/516 |
| 5,531,853 A | | 7/1996 | Cubow et al. | 156/521 |
| 5,560,293 A | | 10/1996 | Boreali et al. | 101/288 |
| 5,607,526 A | | 3/1997 | Buckley | 156/64 |
| 5,674,345 A | | 10/1997 | Nash | 156/264 |
| 5,783,032 A | | 7/1998 | O'Callaghan et al. | 156/556 |
| 5,922,169 A | | 7/1999 | Chodacki et al. | 156/521 |
| 6,006,669 A | | 12/1999 | Klein et al. | 101/485 |
| 6,383,591 B1 | * | 5/2002 | Miles et al. | 428/40.1 |

FOREIGN PATENT DOCUMENTS

| | | | |
|---|---|---|---|
| DE | 3622502 A1 | 7/1986 | B05C/9/14 |
| WO | WO 99/06285 | 2/1999 | B65C/9/18 |

* cited by examiner

*Primary Examiner*—Sue A. Purvis
(74) *Attorney, Agent, or Firm*—Philip G. Meyers

(57) ABSTRACT

The invention relates to a device that is provided with a pressing and applying drum (17) which is driven during start-stop operation and is used for applying the labels (16) to flat objects (20) that are transported along a conveying path. A label strip (1) having a bend that matches the receiving drum surface is pushed onto the side of the pressing and applying drum (17) with the adhesive side thereof facing towards the outside and vertically in relation to the transport plane of the flat objects (20) by means of a label conveying and cutting device (4), whereby said side faces away from the objects (20). The portion which is situated on the stationary pressing and applying drum (17) is cut off by means of a cutter device that is adapted to the bend.

19 Claims, 4 Drawing Sheets

DEVICE FOR APPLYING SELF-ADHESIVE, SUBSTRATE-FREE LABELS TO FLAT ARTICLES

Figure 1:
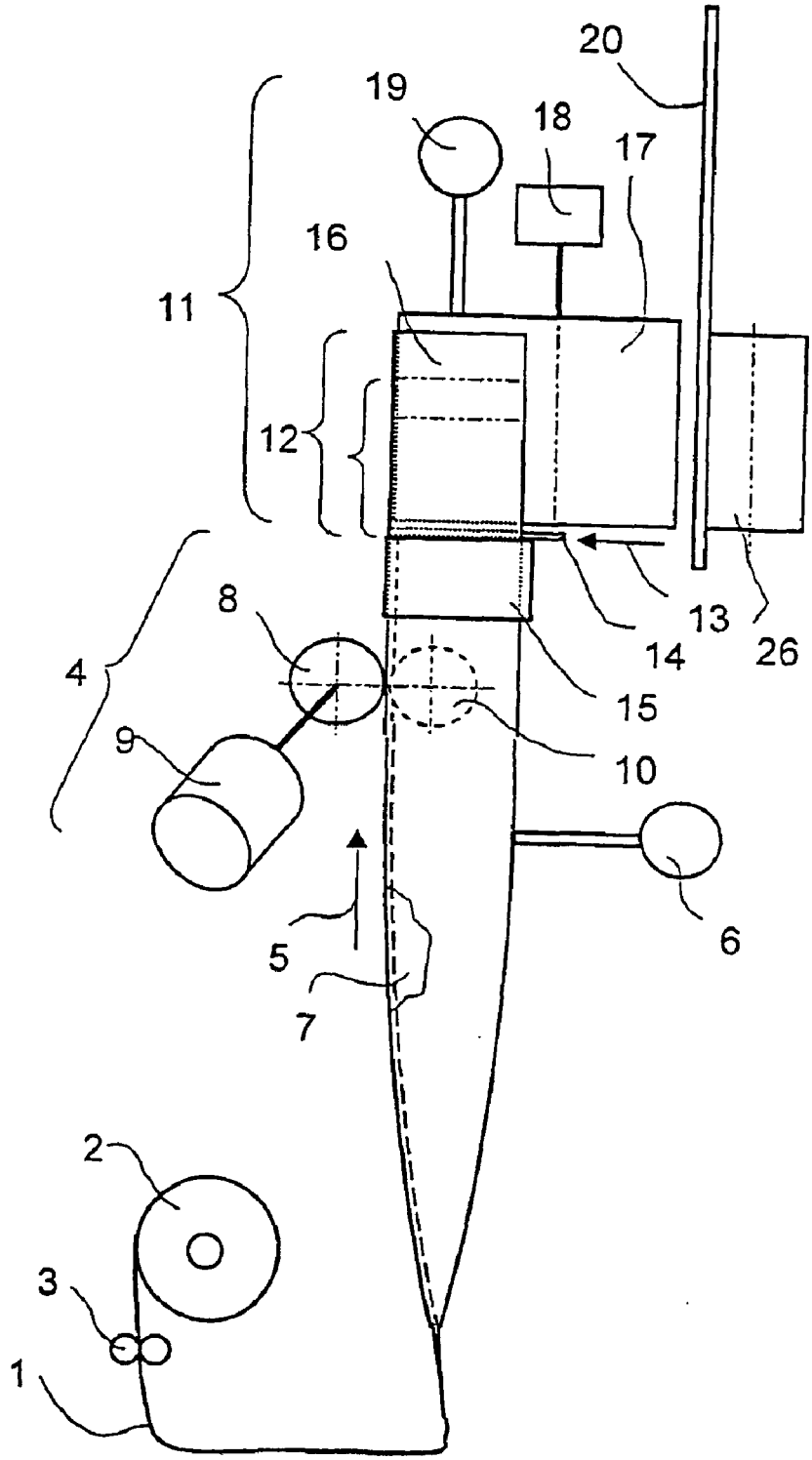

The invention relates to an arrangement for applying self-adhesive, substrate-free labels according to the preamble of patent claim 1.

In the case of flat items of mail, in particular letters, postcards, etc., being processed by mail-transporting companies, the task of applying labels reliably and quickly to flat items of mail poses problems. An example of this is the automatic forwarding of items of mail. In this case, items of mail for forwarding are separated out and addressed in accordance with predetermined data which are stored in a database. A label is stuck onto these items of mail and covers both the old address and a barcode which may possibly have been applied to the surface of the items of mail. The label is then provided with a new barcode and the appropriate new address. The label is applied here in arrangements which are integrated in automatic letter-distributing installations. The items of mail arising in such distributing installations differ in terms of format, weight and thickness. The items of mail are conveyed in such installations, for example, at speeds of 3.6 m/sec, which imposes stringent requirements on the speed at which the labels have to be applied and on the precise positioning of the labels. A general problem, furthermore, is constituted by the handling of the labels, and in particular the transportation of the latter to the surface of the items of mail, if the labels have a self-adhesive surface.

U.S. Pat. No. 5,200,007 describes an arrangement for applying labels to flat items of mail which are transported separately, in a state in which they stand on edge, along a conveying path by a conveying arrangement. It has a label-conveying arrangement for conveying the labels, which are located on a substrate, said label-conveying arrangement being controlled by a sensor means for the purpose of determining the leading edge of the items of mail, and also has a pressure-exerting and applying arrangement for applying the labels to, and pressing them onto, the surface of the items of mail. In this arrangement, the labels are printed with distributing information. Labeling at high transporting speeds of the items of mail is not hereby possible.

DE 36 22 502 A1 describes a labeling-head machine in the case of which the labels are retained on the labeling head, which presses the labels onto the article, with the aid of openings in the head surface, said openings being connected to a negative-pressure source.

The invention specified in claim 1 is based on the object of providing an arrangement for applying self-adhesive, substrate-free labels to flat articles, in the case of which the operation of feeding the labels takes place quickly, with a low level of susceptibility to malfunctioning, and which ensures a high throughput.

Operating the pressure-exerting and applying drum in start-stop operation, it being the case that the label is severed from the label strip when it is at standstill, the drum, for transferring the label to the article, is accelerated to the speed of the latter and is braked again following transfer, with the result that, following a resolution, the drum is ready in the starting position again for accommodating the next label with the adhesive side outwards, and the operation of pushing the label strip, perpendicularly to the transporting plane of the flat articles, onto that side of the pressure-exerting and applying drum which is directed away from the articles, with the curvature corresponding to the accommodating drum surface, and also the operation of severing the label strips located on the pressure-exerting and applying drum, using a cutter means which is adapted to the curvature, allows the labels to be applied quickly and reliably to the articles, which are moving past quickly, with a selectable label height.

Advantageous configurations of the invention are illustrated in the subclaims.

The advantageous configuration of the pressure-exerting and applying drum with a spatially fixed axis of rotation, with a first casing region, which accommodates the labels, and a second casing region, which is offset inwards to the extent where it does not come into contact with the flat articles, thus makes it possible for flat articles to be transported past the pressure-exerting and applying drum without a label being applied to the article.

This effect is achieved in a further advantageous configuration in that the circular-cylindrical pressure-exerting and applying drum is arranged such that it can be moved in a controlled manner toward the transporting path of the flat articles and away from the same. It is particularly advantageous for n arrangements, where $n \geqq 1$, for applying labels to be arranged one behind the other on the transporting path of the flat articles, it being the case that, for application purposes, the surface of the pressure-exerting and applying drum is spaced apart from the respective article by a distance which allows the labels to be pressed on and applied and, when the latter are not being applied, the surface of the pressure-exerting and applying drum is spaced apart from the article by a distance which reliably prevents disruptive contact. The arrangements are then activated in accordance with requirements. This is thus possible to apply a plurality of labels to one article or to label every nth article in order to increase the throughput in each arrangement.

In an advantageous configuration, the label-conveying and cutting arrangement is formed such that the label strip, which is curved to a slight extent, if at all, at the inlet, merges at the outlet into a curvature which is adapted to the label-receiving surface of the pressure-exerting and applying drum. It is advantageous here for openings which are connected to a negative-pressure source to be introduced into this guide surface for the purpose of retaining the label strip on the guide surface.

It is additionally possible for the guide surface, on its lateral borders, to have narrow top surfaces which retain the label strip on the guide surface even without negative pressure and have an adhesive-repelling face.

In order to prevent the label strip from yielding laterally beyond the guide surface, it has, on its lateral borders, boundary surfaces which direct the label strip.

In a further configuration, located in the guide surface is a through-passage for a friction-wheel drive, comprising a friction wheel with a controlled drive and a pressure-exerting roller, which pushes the label strip onto the pressure-exerting and applying drum to the extent envisaged in each case.

In order to ensure that the label strip runs in an aligned, self-adjusting manner over the guide surface of the label-conveying and cutting arrangement, the friction-wheel drive is advantageously mounted pivotably on a swivel pin which is arranged centrally and perpendicularly to the guide surface, upstream of the friction wheel as seen in the label-feed direction.

Figure 2:
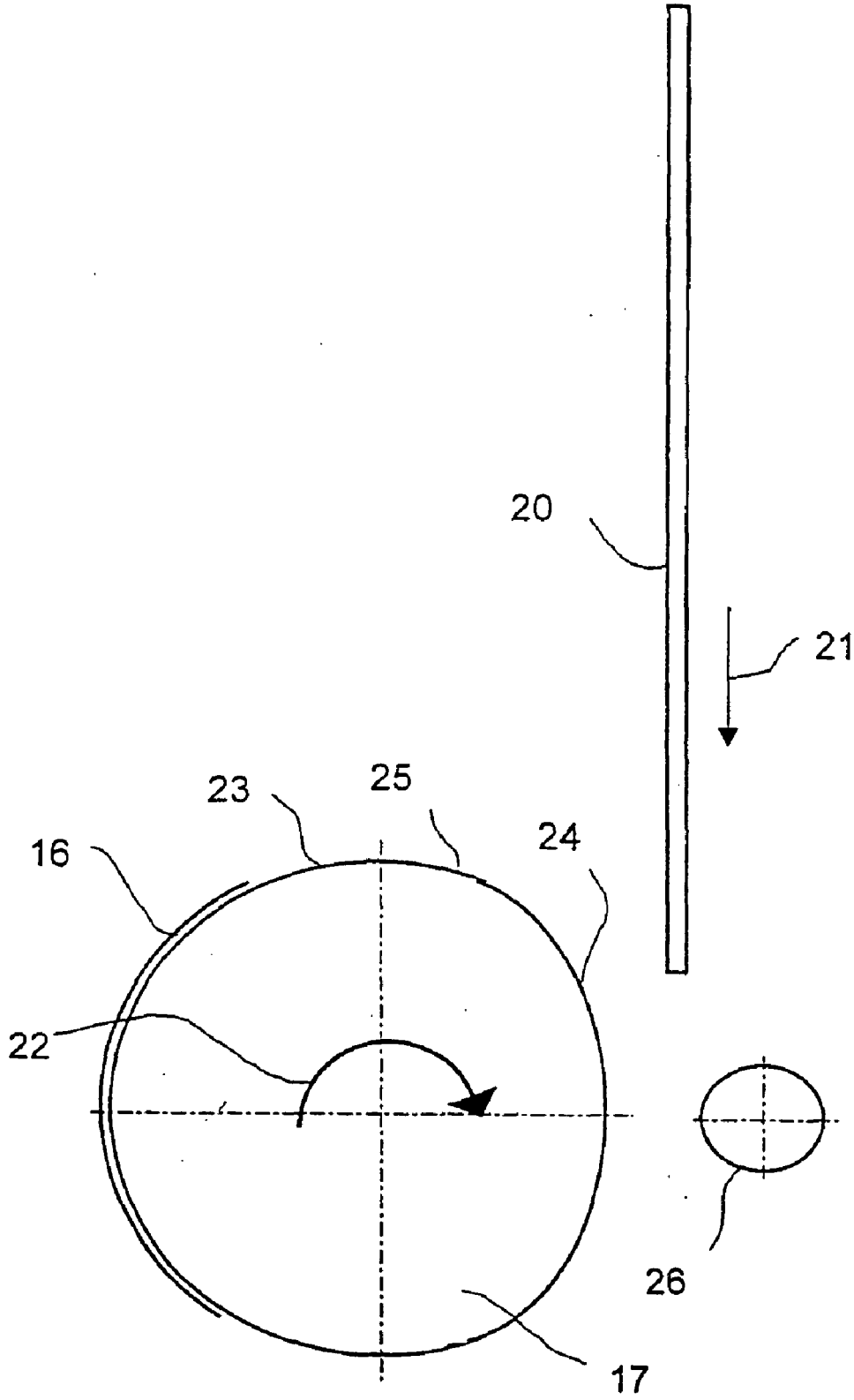
Figure 3:
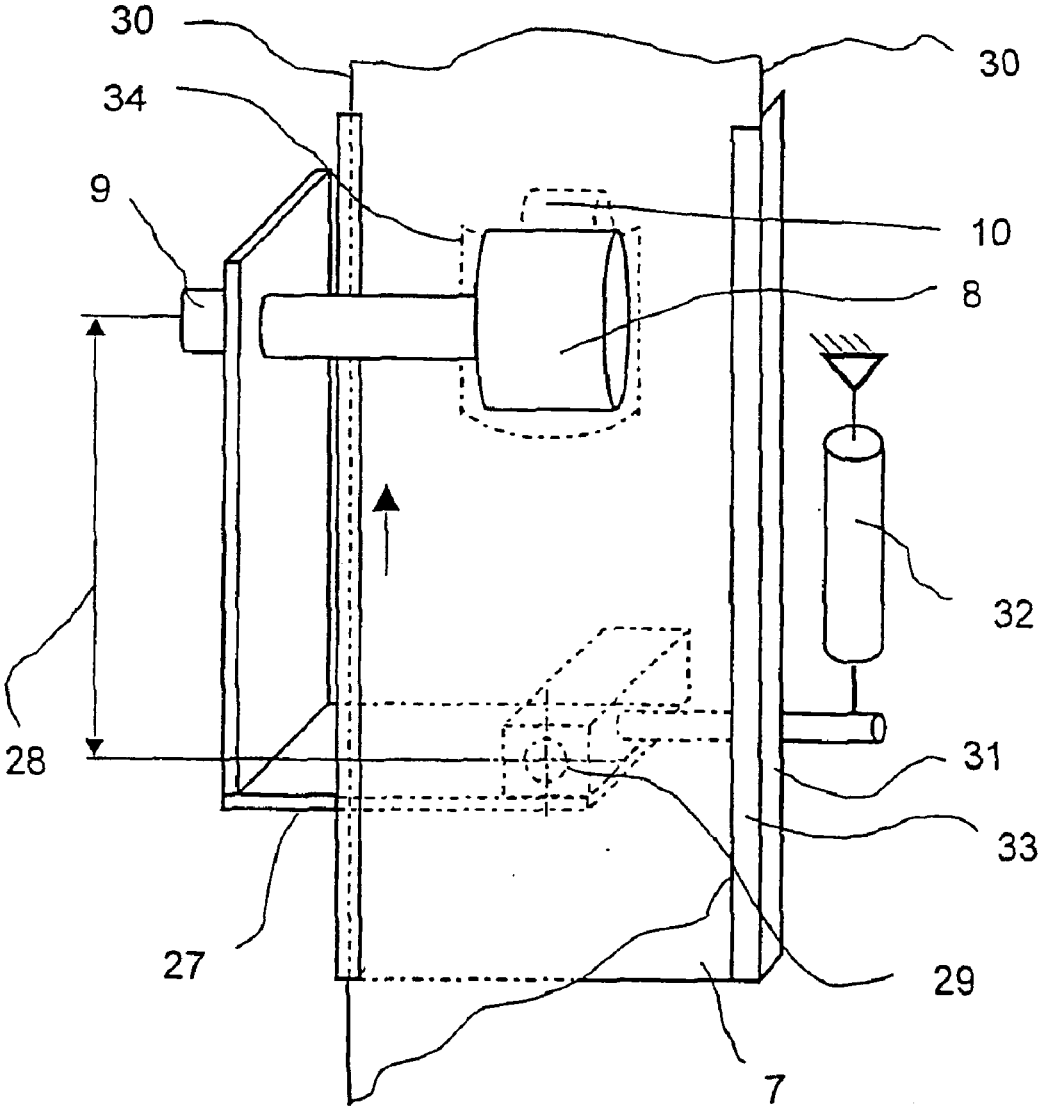
Figure 4:
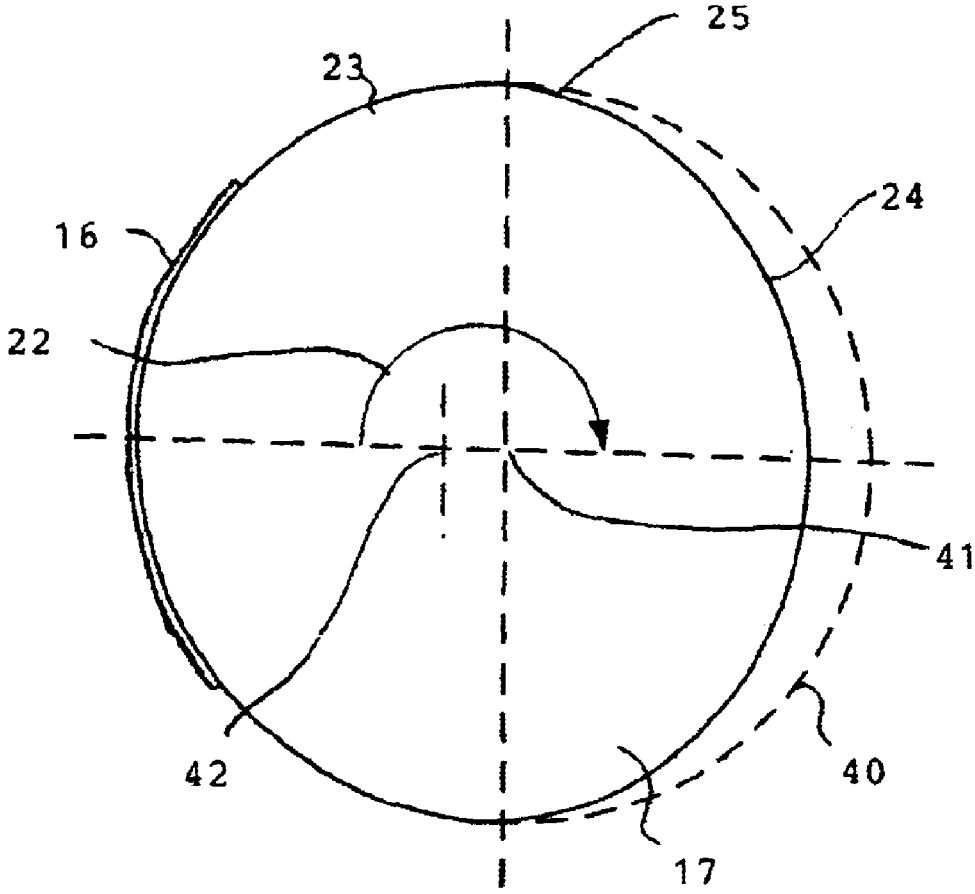

The invention will now be described in more detail by way of an exemplary embodiment and with reference to the drawing, in which:

FIG. 1 shows a schematic side view of the arrangement for applying self-adhesive, substrate-free labels to flat articles, FIG. 2 shows a schematic plan view of the arrangement for applying the labels, FIG. 3 shows a schematic view of the friction-wheel drive and its mounting, and FIG. 4 is a partial schematic side view of an applying drum in accordance with the invention.

The self-adhesive label strip 1 is drawn off in band form from a supply roll 2, by a label-strip-unrolling means 3 which is known per se, and sent to a label-conveying and cutting arrangement 4.

In the label-conveying and cutting arrangement 4, the label strip 1 is advanced onto a pressure-exerting and applying drum 17, in accordance with the required length, perpendicularly to the transporting plane of the flat articles 20 and is cut off with the pressure-exerting and applying drum 17 at a standstill. For this purpose, the label strip 1 is guided over a shaped guide 7 which, in the label-strip advancement direction 5, merges from a guide surface at the inlet which is curved to a slight extent, if at all, into a guide surface at the outlet which has a curvature which is adapted to the label-accommodating surface of the pressure-exerting and applying drum 17.

Openings which are connected to a negative-pressure source 6 are located in the surface of the guide 7. A motor-controlled friction-wheel drive, comprising a friction wheel 8 with drive 9 and pressure-exerting roller 10, is integrated in the guide 7. The label strip 1 is thus pushed in the direction of the labeling means 11, comprising the pressure-exerting and applying drum 17, which, on the accommodating part, likewise has openings connected to a negative-pressure source 19, and also comprising a drum drive 18 and a resiliently mounted mating roller 26, and is itself transferred into a cylindrical shape. Once, with the aid of the friction-wheel drive, the label strip 1 has been advanced up to a height 12 above the cutter means, said height being freely determinable within certain limits, the cutter drive 13 moves the cutter 14 over the label strip 1 onto the mating cutter 15 and shears off a label 16. The label 16 is then borne merely by the pressure-exerting and applying drum 17.

On a suitable transporting means (not illustrated), the articles 20 which are to be labeled are guided past the labeling means 11 at a uniform speed 21 along a path on the side which is directed away from the label-conveying and cutting arrangement 4.

During the cutting of the label strip 1, the pressure-exerting and applying drum 17 remains stationary. Thereafter, it is accelerated, with the label 16, to the same speed as the speed 21 of the article 20, measured on the outer surface of the drum. The movement direction 22 is illustrated in figure 2. A control means synchronizes the drum position and speed with the article 20 which is to have a label stuck to it, with the result that, when the part of the pressure-exerting and applying drum 17 with the label 16 arrives at the article path, the self-adhesive label 16 can be received in a specific manner by the article 20. The casing of the pressure-exerting and applying drum 17 is shaped into a first region 23 and a second region 24. The first casing region 23 has a circular curvature the center point of the circle being located on the axis of rotation. In the case of the second casing region 24, the casing surface is displaced inward to such an extent as to avoid disruptive contact with the articles 20 in the rest position. This casing surface may likewise have the same circular curvature as the first casing region 23, the only difference being that the center point of the circle is displaced beyond the axis of rotation. This configuration is illustrated in FIG. 4, where first casing region 23 has circular curvature corresponding to circle 40 with a center 41 located on the axis of rotation of drum 17. Second casing region 24 has an identical circular curvature with a center 42 that is shifted or displaced to the left relative to center 41, toward first casing region 23. The two casing regions 23, 24 are connected by corresponding transition regions 25. On the one hand, this means that the pressure-exerting and applying drum 17 in rest phases, e.g. during label cutting or pauses in the applying operation, cannot project into the article path and the articles 20 or parts thereof thus cannot be influenced thereby. On the other hand, during the applying operation, it is possible to exert a certain uniform pressure against the flat articles in order to transfer the self-adhesive label 16. In order to assist the operation of transferring the labels onto the articles 20, a counterpressure may be produced by the pressure-exerting roller 26 running along therewith.

The effect achieved by the different casing regions of the pressure-exerting and applying drum 17 with spatially fixed axis of rotation can also be achieved if the pressure-exerting and applying drum 17 is designed as a circular cylinder and if it is mounted in a movable manner in the direction of the articles 20. For application purposes, it is then moved in the direction of the article such that the label can be pressed on and, when the label is not being applied, it is moved back such that contact with the articles 20 is avoided. This configuration is also illustrated in the drawing, but may readily be realized by a person skilled in the art on account of his/her expertise.

The motor-controlled friction-wheel drive, comprising the friction wheel 8 with drive 9 and pressure-exerting roller 10, is mounted on a chassis 27 (figure 3). The friction wheel 8 and pressure-exerting roller 10 are located in a through-passage 34 of the guide 7. Said chassis 27 is mounted pivotably on a swivel pin 29, which is arranged centrally and perpendicularly to the guide 7, at a certain distance 28 upstream of the friction-wheel drive, as seen in the label-strip advancement direction 5. This achieves the situation where the label strip 5 aligns itself automatically, by way of its longitudinal edges 30, with the boundary surfaces 31 fastened laterally on the guide 7. If for whatever reason, for example, one of the longitudinal edges 30 presses onto one of these boundary surfaces 31, then the intention is for it to be possible for said longitudinal edge 30 to yield laterally by way of a guide force arising. This is made possible by the movable arrangement of the friction-wheel drive on the chassis 27. The lateral displacement of the friction wheel 8 results in the friction-wheel drive being positioned obliquely in relation to the conveying direction, and this causes the friction wheel 8 to roll obliquely over the label strip 1 and the lateral deflection of the chassis 27 thus to be eliminated. The chassis 27 may be influenced in its zero position by the force of a spring 32. Variation of the spring force makes it possible to orient the label strip 1 on one of the two boundary surfaces 31. In order that the borders of the label strip I cannot lift off from the guide 7 even when the negative-pressure source 19 has been switched off, a pair of narrow retaining strips 33 with adhesive-repelling faces are provided on the boundary surfaces 31.

What is claimed is:

1. A device for applying self-adhesive labels to flat articles transported separately along a conveying path comprising:

a label applying drum, the drum having an axis of rotation and first and second casing regions;

the first casing region having a circular curvature with a center point located on the axis of rotation of the drum and being adapted to receive and rotate to apply labels moving along the conveying path;

a drum drive for rotating the drum such that the first casing region contacts a flat article traveling along the conveying path to apply a label to the article;

a label feeder for feeding a continuous strip of labels onto the drum over the first casing region, the label feeder moving the strip of labels in a direction parallel to the axis of rotation of the drum and curving the strip of labels to conform to the curvature of the first casing region; and a plurality of holes formed in the surface of the drum in the first casing region, said holes being connected to a negative pressure source to retain a label on the label applying drum.

2. The device of claim 1, wherein the second casing region has a surface displaced inwardly toward the axis of rotation such that flat articles traveling along the conveying path do not contact the drum second casing region when the second casing region is positioned adjacent the conveying path.

3. The device of claim 2, further wherein the drum drive rotates the drum at a speed such that the velocity of the surface of the first casing region is substantially equal to the velocity of flat articles traveling along the conveying path when the drum contacts the flat articles to apply a label.

4. The device of claim 1, wherein the label feeder and drum are configured to apply labels having differing lengths to flat articles.

5. The device of claim 4, further comprising a label cutter for cutting a label from the strip of labels.

6. The device of claim 1, further comprising a guide including a guide surface having an input end for receiving the strip of labels and an output end for guiding the labels onto the drum, the guide surface curving progressively inward from the input end to the output end such that the curvature of the guide at the output end matches the radius of curvature of the first casing region, the guide further comprising boundary walls extending perpendicular to each edge of the guide for guiding the strip of labels therebetween as the strip of labels is moved along the length of the guide.

7. The device of claim 6, further comprising a guide strip extending inwardly from each boundary wall for maintaining the strip of labels between the boundary walls.

8. The device of claim 6, wherein the guide surface comprises a centrally located hole and wherein the device further comprises a friction wheel disposed over the hole for driving the strip of labels along the guide.

9. The device of claim 8, further comprising a roller, the roller being opposed to the friction wheel through the opening in the guide surface.

10. The device of claim 9, wherein the friction wheel and roller are pivotally mounted for guiding the strip of labels.

11. A device for applying self-adhesive, substrate-free labels to flat articles conveyed along a conveying path, comprising:

a rotatable drum having first and second casing regions, the first casing region having a surface with a plurality of holes formed therein, the holes being connected to a negative pressure source to retain a label thereon, the drum being rotated to transfer the label from the first casing region to a flat article traveling along the conveying path with a cylindrical surface of the first casing region surrounding the label in contact with the flat article, the drum being positioned with the second casing region facing the conveying path to receive a label on the first casing region, the second casing region having a surface displaced inwardly toward the axis of rotation of the drum such that the surface of the second casing surface is spaced from the conveying path when the second casing region is turned toward the conveying path; and a label strip guide having an input end for receiving a strip of labels and output end for guiding the strip onto the first casing region, the guide extending parallel to the axis of rotation of the drum such that the strip is guided over an end of the drum.

12. The device of claim 11, further comprising a resilient roller, the roller opposing the first casing region to press a flat article traveling along the conveying path against the first casing region to transfer a label from the first casing region to the flat article.

13. The device of claim 11, wherein the guide has a guide surface that is progressively curved from the input end to the output end so that the label strip is curved to conform to the curvature of the first casing area as it is guided over the end of the drum.

14. The device of claim 13, wherein the guide further comprises boundary walls perpendicular to the guide surface for constraining the strip of labels moving along the guide surface.

15. The device of claim 14, further comprising a retaining strip extending inwardly from an upper edge of each of the boundary walls to retain the strip of labels between the boundary walls.

16. The device of claim 13, wherein the guide surface has a centrally located hole therein and wherein the device further comprises a friction drive wheel and roller positioned to contact the strip of labels on opposing sides through the hole and drive the strip of labels along the guide.

17. The device of claim 16, wherein the friction wheel and drive roller are pivotally mounted.

18. The device of claim 13, further comprising a strip cutter for cutting a portion of the strip of labels positioned on the first casing region from the remainder of the strip.

19. The device of claim 13, further comprising a sensor for detecting the position of a flat article to be labeled.

* * * * *